US007763168B2

(12) United States Patent
Grimwood

(10) Patent No.: US 7,763,168 B2
(45) Date of Patent: Jul. 27, 2010

(54) CONTROL OF CENTRIFUGES

(75) Inventor: Geoffrey Clive Grimwood, Holmfirth (GB)

(73) Assignee: Thomas Broadbent & Sons Ltd (GB)

( * ) Notice: Subject to any disclaimer, the term of this patent is extended or adjusted under 35 U.S.C. 154(b) by 0 days.

(21) Appl. No.: 10/853,073

(22) Filed: May 25, 2004

(65) Prior Publication Data

US 2005/0011837 A1 Jan. 20, 2005

(51) Int. Cl.
*B04B 13/00* (2006.01)

(52) U.S. Cl. ..... 210/86; 210/97; 210/143; 210/360.1; 210/369; 494/6; 494/10; 494/36

(58) Field of Classification Search ..... 210/86, 210/94, 95, 106, 107, 143, 360.1, 369, 745, 210/781, 784, 97; 494/4, 5, 10, 36, 6
See application file for complete search history.

(56) References Cited

U.S. PATENT DOCUMENTS 4,867,886 A * 9/1989 Botkins, Jr. ..... 210/709
6,143,183 A * 11/2000 Wardwell et al. ..... 210/739

FOREIGN PATENT DOCUMENTS

DE 1 588 029 4/1981
DE 44 12 899 A 4/1994
DE GB 195 15 870 C 4/1995
EP 0679722 11/1995
EP 0891814 1/1999
JP 04004058 4/1992
JP 5-126726 5/1993

OTHER PUBLICATIONS

U.K. Patent Office: Search Report under Section 17 for GB 0310403.1 dated Nov. 2003.
European Search Report for EP 04252545 dated Aug. 2005.

* cited by examiner

*Primary Examiner*—Matthew O Savage
(74) *Attorney, Agent, or Firm*—Joseph C. Andras

(57) ABSTRACT

A method of controlling a centrifuge of the type having a rotating perforated basket on whose inner peripheral wall a liquids/solids slurry is caused to collect in use, with separated liquid being collected via the basket perforations. The method comprising taking depth measurement of the material in the rotating basket continuous or at repeated intervals, over a basket cycle from commencement of slurry feed to discharge of solids, using at least one laser unit adapted to direct a beam of coherent light energy towards said inner peripheral wall of the basket of solids. The depth measurements can be made using at least one laser unit (30) adapted to direct a beam of coherent light energy towards said inner peripheral wall of the basket.

12 Claims, 8 Drawing Sheets

CONTROL OF CENTRIFUGES

FIELD OF THE INVENTION

The present invention is concerned with the control of centrifuges and, in particular, of industrial centrifuges of the type comprising a rotating perforated drum or basket (hereinafter referred to as a "basket"), on whose inner peripheral wall a liquids/solids slurry is caused to collect, with the separated liquid being collected via the basket perforations.

BACKGROUND OF THE INVENTION

The utilisation of industrial centrifuges depends to a large extent on the control equipment fitted to ensure that the degree of separation of the solids and liquid constituents of the feed slurry meets the process requirements in the minimum time and with the minimum use of resources (power, time, wash liquid, etc.). In addition the controls should provide data for centralised overall process optimisation. By ensuring that the centrifuge is fully loaded with feed slurry and then measuring accurately and continuously the volume of material in the rotating basket as the centrifuge cycle proceeds, adjustments to feed, wash, rpm, spin time, etc. may be made to optimise performance for that particular basket load under rotation—rather than rely upon preset mean values that remains unchanged for successive cycles. Where variations are inherent in the process (e.g. feed rate, solid/liquid ratio, solids wash, etc.) control adjustments are essential during each centrifuge cycle to achieve full process optimisation of each cycle independently.

FIG. 1 of the accompanying drawings shows a typical batch type centrifuge having a basket 1 supported on a drive shaft 2 and contained in a stationary outer casing 3. When the empty basket 1 is rotating, a feed valve 4 opens to allow slurry 5 to flow into the suspended rotary, perforated, open top basket and, under the centrifugal force of rotation, to form a cylindrical batch of slurry (i.e. the near cylindrical volume 6 on the inner basket wall) of radial depth (D). A perforated screen 7 covering the inner basket wall supports the solids but allows the liquid to flow to the outer casing 3 through the screen openings and perforations 8 in the basket wall, thus commencing the separation of the solids from the liquid. For illustration purposes, FIG. 1 shows a centrifuge with a suspended overdriven basket. The descriptions that follow apply equally well to under-driven, horizontal and inclined spindle centrifuges.

An existing method of closing the feed valve 4 by measuring the slurry depth (D) in the basket (and hence the slurry volume) uses a blade 9 mounted on a supporting arm 10 which in turn, is supported by and is free to rotate in an arc in a bearing 11 mounted on the outer casing top 12. When feeding slurry commences, the blade 9 is rotated to position (A) and, as the basket fills, rides on the surface of the slurry and is displaced to position (B) to operate a switch to close the feed valve. Position (B) is preset so that the inner surface of the slurry is approaching the basket lip 13 but set with sufficient margin (C) to avoid overflow of slurry over the basket lip.

During feeding, liquid flows through the screen 7 and perforations 8 as separation commences. After the movement of the blade 9 has been detected and the feed valve 4 closed, the liquid flow through the screen reduces the slurry volume and depth (D) in the basket to increase the dimension (C). It is advantageous on some processes to reopen the feed valve for a short preset time to add just sufficient extra slurry to compensate for the liquid separated so far—thus increasing the total amount of slurry processed. Again the short preset time is restricted by the limitations described in (c) below to avoid slurry overflow over the basket lip.

This existing method of feed control described above has operational limitations, including:

(a) To exert sufficient force to operate a switch (which in turn closes the feed valve 4), blade 9 is depressed below the surface of the slurry, introducing an error in depth measurement.

(b) This depression generates waves on the inner surface of the slurry which result in a measurement error and vibration and overflow unless allowance is made in setting position (B) to increase margin (C)—thus reducing the volume of slurry processed.

(c) For applications where the process parameters vary the rate at which the slurry flows to the basket, position (B) is set to avoid overflow in the "worst case" (i.e. highest slurry temperature, lowest viscosity, lowest solids content, etc.,). At these preset settings, the slurry fed to a centrifuge operating with parameters other than the "worst case" will be less than the optimum.

An existing alternative method of closing feed valve 4 uses an ultrasonic retro-reflective system to measure the depth and volume of the rotating slurry cylinder 6. FIG. 2 of the accompanying drawings shows the part-section of a centrifuge basket, casing and casing top in which is mounted an ultrasonic unit 20 that extends into the basket interior. The ultrasonic unit comprises a sound generator 21, a sound receiver 22 and a sound reflector plate 23 mounted in a supporting tube 24 fixed to the casing top 12. The generator 21 produces a series of ultrasonic pulses directed along the tube 24 to reflect on plate 23 and the slurry surface (or basket inner surface) to return via plate 23 to the receiver 22 mounted close to, or concentric with the generator 21. The dotted line in FIG. 2 shows the path 25 taken by the sound pulses. By comparing the time taken for the sound pulses to travel over path 25 with and without slurry in the basket, the unit converts the time difference to a measure of the depth (D) of the slurry. As the depth (D) of the slurry fed increases and the margin (C) is approached the signal is used to close the feed valve.

This alternative method also has operational limitations, including:

(d) The velocity of sound in air varies with the air temperature, humidity and air movement, leading to an error en depth measurement with any change in these characteristics.

(e) Liquid droplets, vapours, steam and air movement in the basket all vary with the basket speed and diminish the strength of the sound pulses returned to the receiver 22. The disturbance and diminution increases sharply with basket speed, limiting measurements to low basket speeds.

(f) For applications where the process parameters vary, without the measure of the rate of flow of slurry being made, the margin (C) must be preset for the "worst case"—a limitation on process optimisation described in (c) above.

A further existing method of closing the feed valve also uses an ultrasonic system, placing the sound generator 21 and sound receiver 22 inside the basket 1 in the position occupied by the reflector plate 23 which is not used. The ultrasonic pulses pass directly from the sound generator to the slurry surface and reflect back directly to the sound receiver. This method has the limitations given in (d), (e) and (f) above.

These prior art methods limit the slurry fed to the basket to less than the maximum by ensuring that the margin (C) is sufficient to avoid the overflow of slurry over the basket lip and to offset the limitations of the system. The penalty for an overflow is severe. Firstly the unseparated solids require reprocessing and may contaminate the separated liquid, and secondly the overflow causes basket unbalance, vibration and a centrifuge shutdown for the basket load to be rebalanced before the centrifuge cycle can proceed.

Furthermore, the methods described above control the closure of the feed valve 4 prior to acceleration and spinning for final separation and play no further part in the optimisation of the centrifuge cycle or the process after the feed valve closes.

It is an object of the present invention to provide a means for overcoming or at least mitigating at least some of the aforegoing shortcomings of the known systems.

SUMMARY OF THE INVENTION

In accordance with a first aspect of the invention there is provided a centrifuge comprising a rotating perforated basket on whose inner peripheral wall a liquids/solids slurry is caused to collect in use, with separated liquid being collected via the basket perforations, in which the depth of liquids/solids slurry on the basket wall is measured by means of a laser.

Preferably, the laser is coupled to a computing device which enables the depth of material rotating in the basket to be monitored continuously.

Advantageously, the computing device is arranged to calculate the rate of feed of materials to the basket to enable maximum basket slurry loading.

Preferably, the computing device is adapted to calculate continuously over time or at repeated intervals over time the depth and/or volume of material in the basket over the centrifuge cycle, from commencement of slurry feed to discharge of solids.

The results from a series of laser measurements of the material depth in the basket can be arranged to be used by the computing device for optimising slurry feed and basket loading over complete operational cycles of the centrifuge.

Preferably, the computing device is a programmable logic controller (PLC). In some embodiments, the laser comprises a laser unit disposed at a location within the basket for directing a continuous stream of pulses, or a continuous beam, of coherent light energy towards said inner peripheral wall of the basket.

In other embodiments, there can be a plurality of laser units disposed at different respective locations on the basket for measuring the depth of material in the basket at each such location.

In further embodiments, the laser can be displaceable within the basket for taking such depth measurement at a series of different locations within the basket.

In still further embodiments, the laser can comprise a laser unit disposed at a location outside the basket and adapted to direct a continuous stream of pulses, or a continuous beam, of coherent light energy towards a prism disposed within the basket which redirects the continuous stream of pulses, or the continuous beam, towards said inner peripheral wall of the basket and reflects it back to the laser unit.

In some such embodiments, the prism can be mounted displaceably within the basket to enable such depth measurement to be taken at a series of different locations within the basket.

In accordance with a second aspect of the present invention there is provided a method for controlling a centrifuge of the type having a rotating perforated basket on whose inner peripheral wall a liquids/solids slurry is caused to collect in use, with separated liquid being collected via the basket perforations, the method comprising taking depth measurement of the material in the rotating basket continuously or at repeated intervals, over a basket cycle, from commencement of slurry feed to discharge of solids.

Preferably, the depth measurements are made using at least one laser unit adapted to direct a beam of coherent light energy towards said inner peripheral wall of the basket.

Advantageously, the distance (M) of the laser unit from said inner peripheral wall of the basket is measured with the basket empty and then either continuously or at repeated intervals the distance (m1, m2, m3 . . . ) to the slurry surface is made when a slurry is present in the basket, the difference (M−m1, M−m2, M−m3 . . . ) being calculated to establish the prevailing slurry depth.

It can be useful for a comparison to be made from said differences between successive calculations to establish the rate of change of depth for the purposes of controlling the progress of the centrifuge cycle.

In preferred embodiments of the invention therefore, there is provided a centrifuge fitted with an internally or externally mounted laser measuring unit and a PLC to monitor the depth of material rotating in the basket continuously. A laser/PLC control system measures the rate of feeding to give maximum basket slurry loading. Adjustments to various stages in the centrifuge cycle following feeding, derived from the series of laser measurements can be used to maximise the centrifuge performance and utilisation over each complete cycle.

Advantages over prior art systems include the ability to measure basket material depth frequently and continuously throughout the centrifuge cycle without contacting the material surface and without signal loss, distortion and inaccuracies that result from droplets, vapour, air movement, steam and temperature changes present in the rotating basket during processing. Further advantages can accrue from the provision of useful data to central process control to optimise each centrifuge operation, provide data to improve the process both upstream and downstream of the centrifuge and minimise both product losses and the use of resources.

By measuring the depth/volume of material in the basket accurately over the complete centrifuge cycle, from commencement of slurry feed to discharge of solids, the limitations of prior art methods of feed control can be overcome. In addition the measurements can be used subsequently to optimise the remainder of the cycle (i.e. accelerate, wash, spin, decelerate etc.) and contribute data to a central computer for overall process optimization.

Continuous measurement is made of the amount of material in the rotating centrifuge basket; for example to maximise the volume processed, minimize product losses, adjust the wash liquid used to the minimum required and set the spin time for the solids volume retained in the basket, making measurements and adjustments specific to each centrifuge cycle and providing data for process measurements and optimisation.

DESCRIPTION OF THE DRAWINGS

These and other features, aspects and advantages of the present invention will be more fully understood when considered in connection with the following specification and appended claims. The invention is described further hereinafter, by way of example only, with reference to the accompanying drawings, in which:

DESCRIPTION OF THE INVENTION

Figure 1:
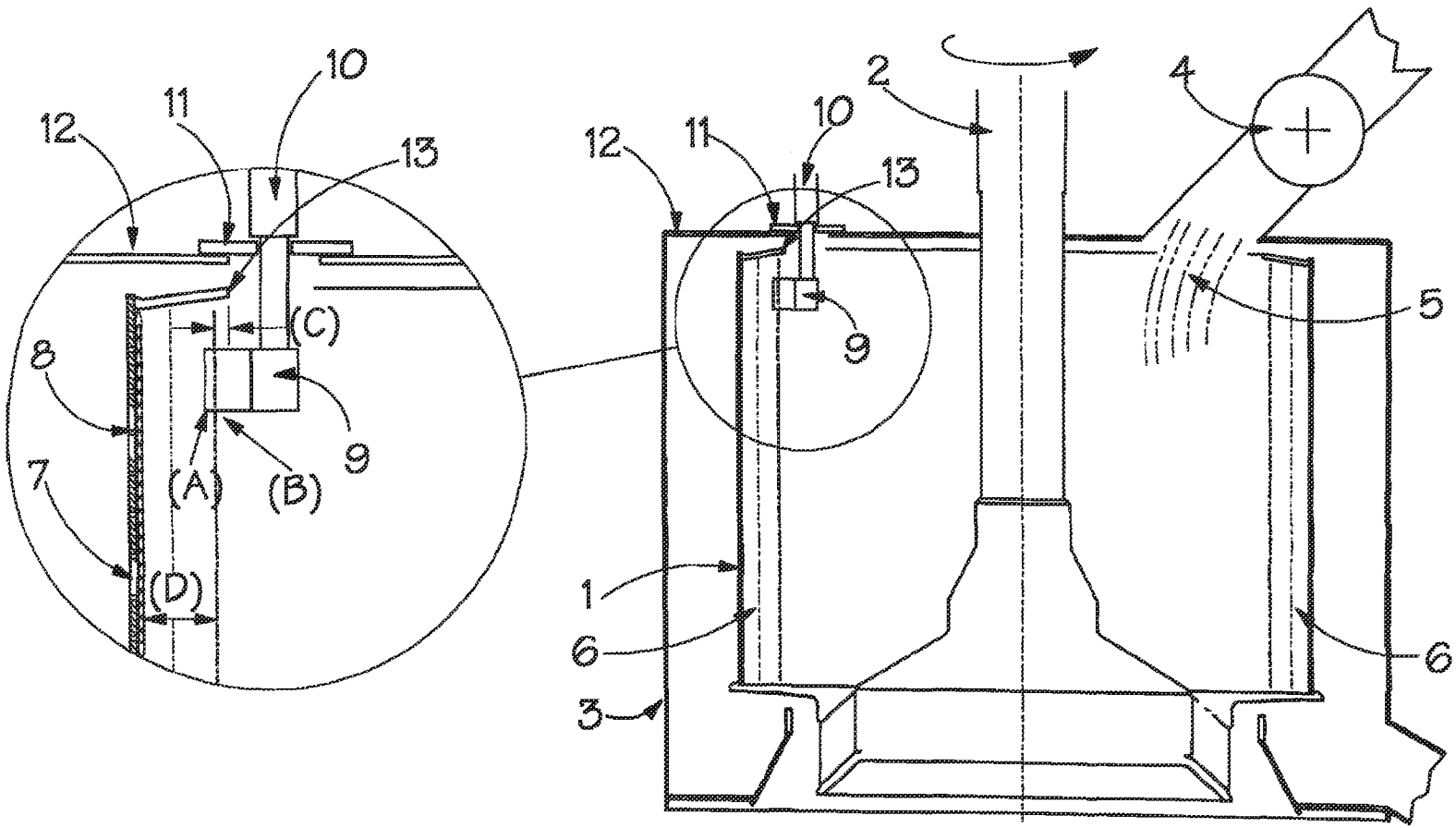
FIG.1. PRIOR ART
FIG. 1 is a diagrammatic sectional side elevation of a typical batch-type centrifuge using a first known method for detecting and controlling slurry depth in the basket.
Figure 2:
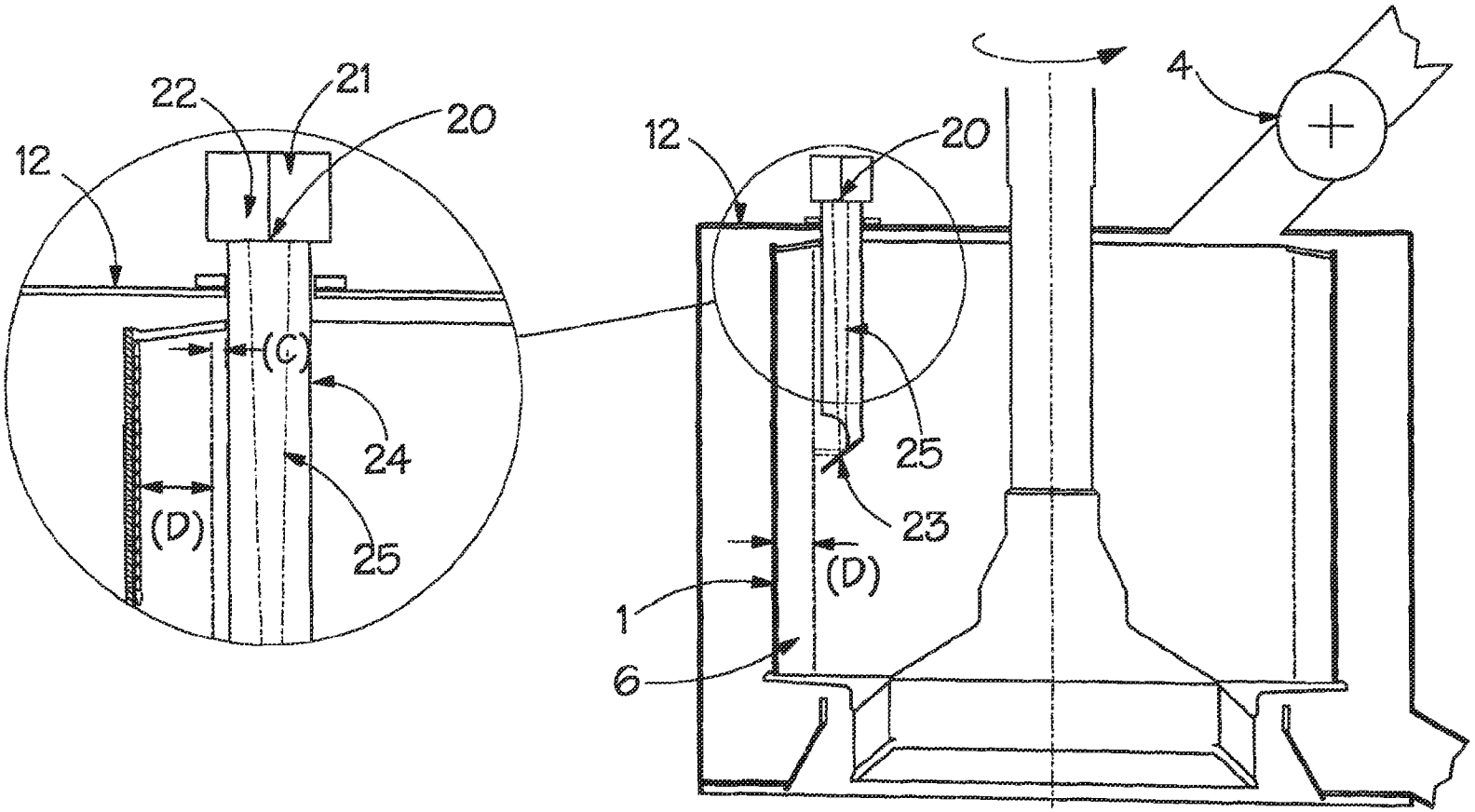
FIG.2. PRIOR ART
FIG. 2 is a diagrammatic sectional side elevation of the centrifuge of FIG. 1 using a second known method for detecting and controlling slurry depth in the basket.
Figure 3:
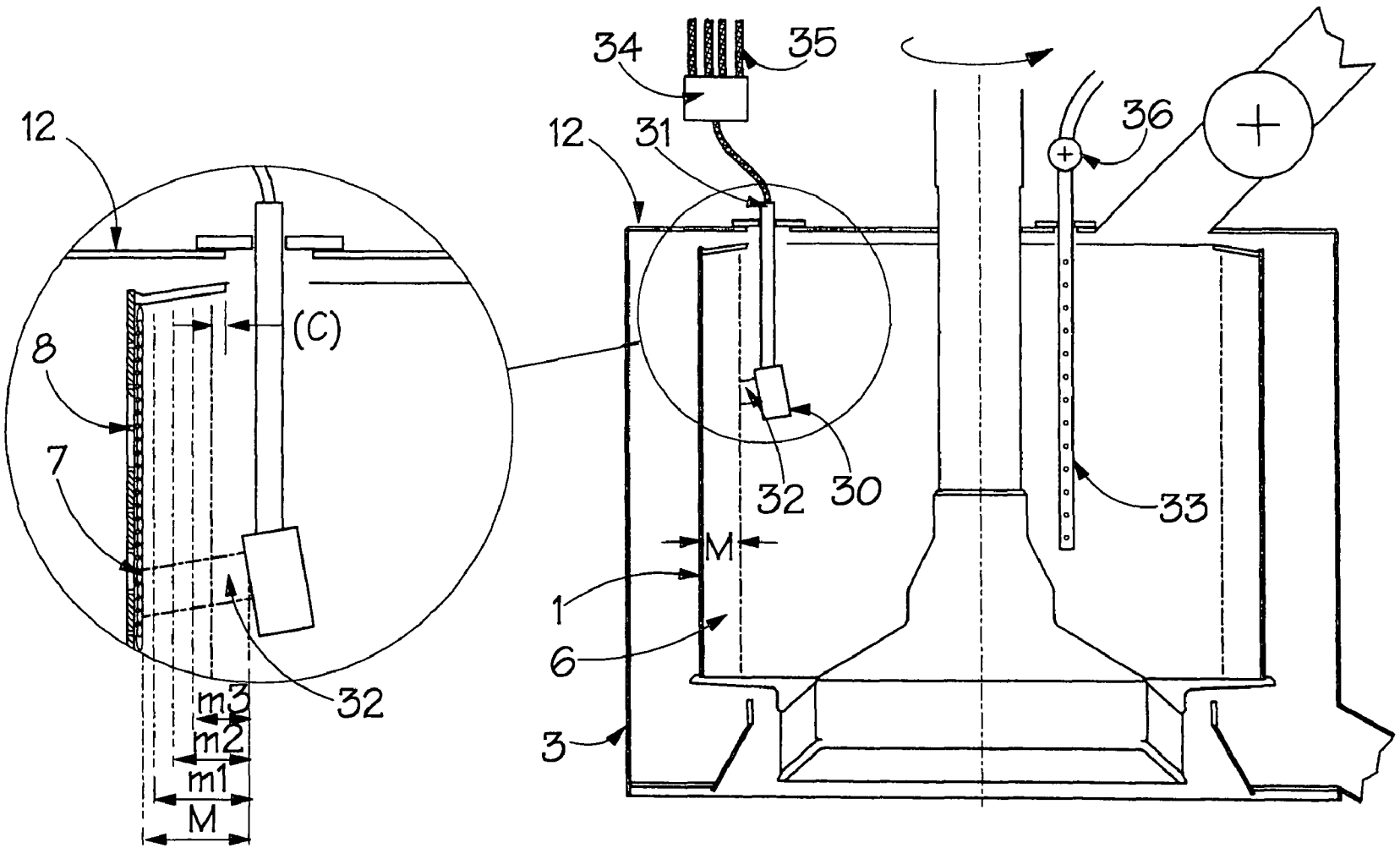
FIGS. 3 and 4 are diagrammatic sectional side elevations of first and second embodiments of centrifuges modified in accordance with the present invention.
Figure 4:
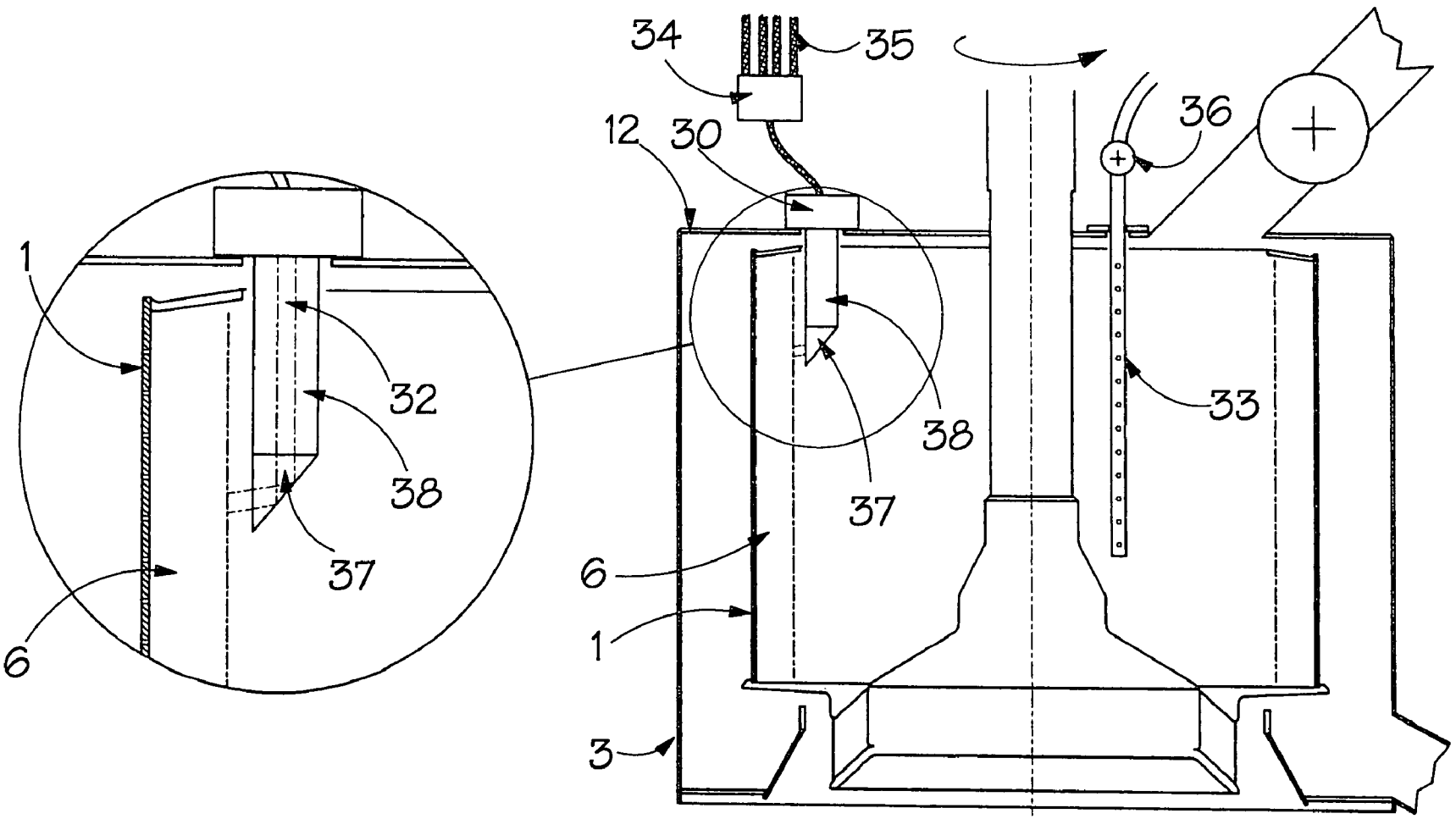

Referring now to FIG. 3, the first embodiment in accordance with the present invention has a basket 1, casing 3 and casing top 12 as in the centrifuges illustrated in FIGS. 1 and 2. The principal difference lies in the use of a laser to measure the material depth in the basket. As shown in FIG. 3, a laser unit 30 is mounted inside the basket, supported by a bracket 31 fixed to the casing top so that it is non-rotating and pointed towards the cylindrical slurry volume 6 rotating in the basket which, as shown in original FIG. 3, moves past the non-rotating laser unit 30. FIG. 4 shows an alternative arrangement with the laser unit 30 mounted on the outside of the casing top 12 and pointed indirectly to the volume 6 via a reflecting prism (or the equivalent) 37 supported inside the basket by a bracket 38. The descriptions that follow give in detail the operation of the arrangements in both FIGS. 3 and 4.

The laser unit 30 emits a continuous series of pulses (or a continuous beam) of coherent light energy along path 32 that illuminates an area in the shape of a circular spot or rectangle. The shape used depends upon the application, with a rectangular shape of high aspect ratio, and with its long side parallel to the drive shaft 2, being preferred for applications in which particulate solids are present on the slurry inner surface. During each pulse, the laser unit then measures its distance from the centre of the illuminated area and repeats the measurement for each successive pulse (at frequent time intervals) to provide a series of measurements of the distance between the unit and the surface of the material, As shown in original FIG. 3. The distances measured are supplied to a programmable logic controller (PLC) 34 to convert and program these input signals to outputs 35 for centrifuge cycle control and process optimisation. Firstly, the laser unit (or any suitable measuring device) measures and the PLC registers the distance (M) to the inner wall of the empty basket. Secondly, at each successive pulse throughout the centrifuge cycle, the laser unit measures distances (m1; m2; m3 . . . ) to the material surface and supplies these measurements to the PLC.

The PLC 34 is programmed to calculate the material depth in the basket at each pulse (and at frequent intervals of one second or less) by subtracting each successive measurement from (M) i.e. {(M) minus (m1; m2; m3; . . . )}. The program then calculates the depth, the rate of change in depth, material volume etc. and gives output signals to control/adjust the complete centrifuge cycle and provide data for process optimisation as described below.

Experiments confirm that, compared with the prior art ultrasonic system, the difficult conditions of steam, liquid droplets, vapours, etc. that occur in centrifuge baskets do not materially effect the accuracy of the laser depth measurement whatever the speed of rotation of the centrifuge basket—an advantage attributed to the much shorter wavelength and coherency of the light pulse compared with the longer wavelength random ultrasound and the absence of any distortion of the light beam by air movement.

To control the slurry feed to the basket, the PLC 34 receives the initial series of pulse measurements as the basket fills and estimates the rate at which the basket depth is changing (i.e. the rate at which the basket is filling with slurry less the outflow of separated liquid). When the basket is (X %) full, where X lies between 40% and 95%, the PLC signals the commencement of closure of the feed valve. The feed valve flow opening/closing characteristics are recorded as part of the PLC program, which then calculates the rate at which the feed valve is to close to fill the basket to maximum depth (M) with minimum margin (C) for overspill. Optimum filling is then obtained by adjusting and pre-setting the value of (X %) in the light of the feed time allowed in the overall centrifuge cycle.

With the basket fully loaded it is accelerated to spin speed to complete the solid/liquid separation. At or near spin speed it may be necessary to wash the solids to remove contaminants and surplus liquid from the solid's surfaces. FIGS. 3 and 4 show a wash pipe 33 fitted inside the basket to spray wash liquid to pass through the solids bed 6, to flow through the screen 7 and perforations 8 into the outer casing 3. Wash liquid is supplied to the wash pipe 33 via a valve 36. To minimise the use of wash liquid and the loss of solids (if they are soluble in the wash liquor), the wash is applied when the bulk of the liquor in the slurry has been separated be centrifugal force. To wash too early during acceleration calls for excess wash liquid to remove slurry liquid that would otherwise be removed by centrifugal force: to wash too late calls for extra spin time to remove the wash liquor from the solids. The PLC program assesses the rate of slurry flow (from the rate of diminution of the successive measurements of slurry depth/volume) to signal the correct time for wash to commence.

Figure 5:
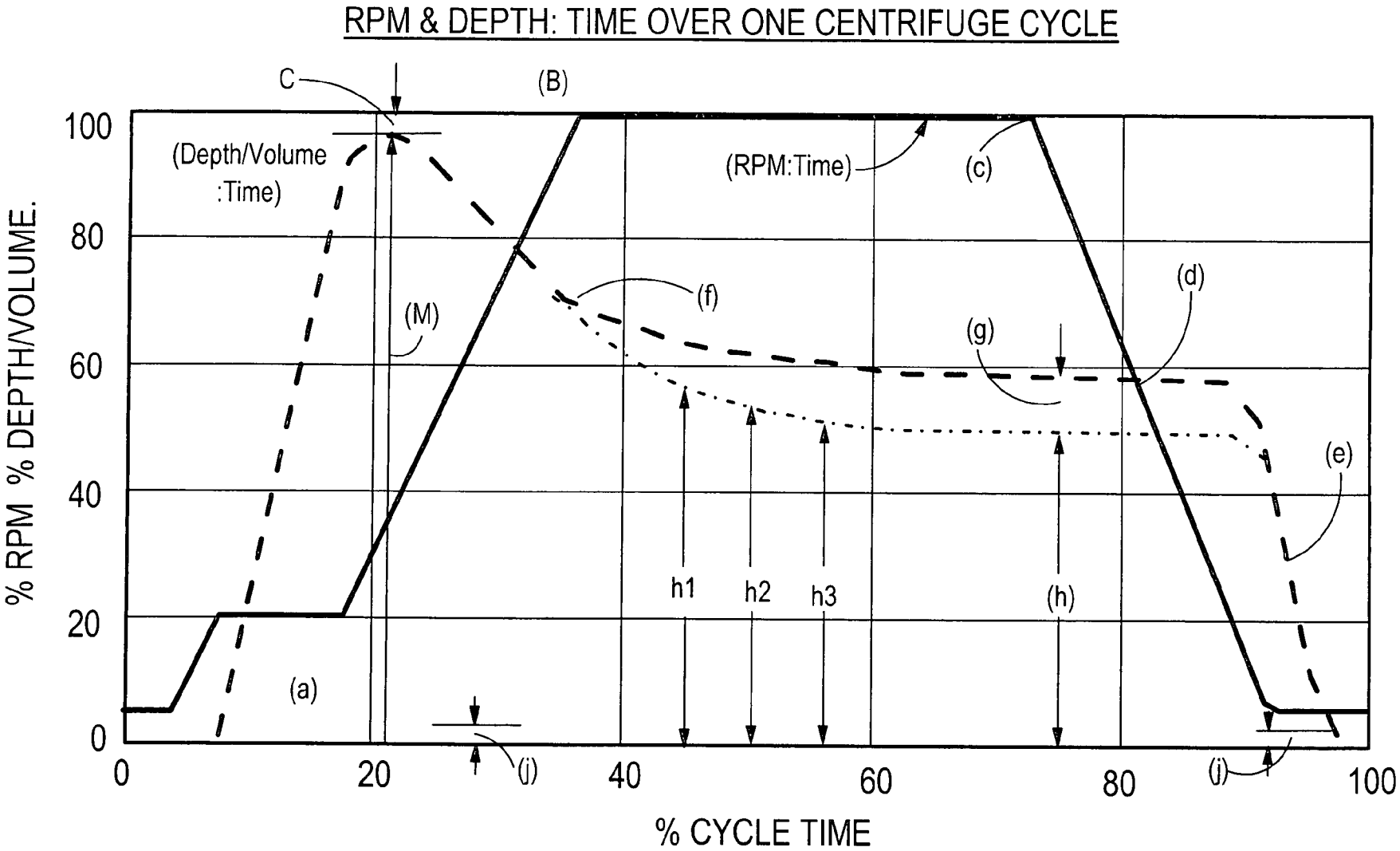
FIG. 5 is a depth/time diagram illustrating an example of an operating cycle of a centrifuge in accordance with the present invention.

As the slurry liquid is centrifuged off, the solids surface recedes. The series of output signals from the PLC connected to the laser indicate the reduction in the depth (D) and hence the volume occupied by the solids product in the basket as the liquid leaves the basket. FIG. 5 shows typical depth measurements taken, related to the cycle time and centrifuge speed of rotation from the start of a cycle, through slurry feed at feed speed (a) through acceleration to spin speed (b) to the end of spinning (c), deceleration (d) and discharge (e)—with the speed shown in full line and the depth/volume measurements in dotted line.

The volume of wash liquid required is proportional to the volume of solids in the basket. The PLC program can be written to:

(i) Calculate the volume of wash liquid needed as a set % of the measured solids volume recorded prior to washing.

(ii) Signal the correct time for wash to commence.

(iii) Open the wash valve 36.

(iv) Calculate the duration of washing to deliver the wash volume needed. If the wash liquid pressure and/or temperature are not constant, input of these as variables to the PLC allows the calculation of wash time to corrected for such variations.

(v) Close the wash valve when the correct wash liquid volume has been delivered.

With the wash taking place at (t) in FIG. 5 the depth/time graph will appear as shown in dashed line, indicating that wash has occurred and the extent of loss of any soluble solids (g). Depth (h) gives the volume of solids produced from the centrifuge cycle. Both solids produced and soluble solids loss are useful data for process optimisation: summing the solids produced over time provides hourly/daily throughputs and solids loss indicates a reprocessing load.

The liquid flow from the basket diminishes as the centrifuge runs at maximum speed until the depth (h) shown in FIG. 5 remains constant. In the prior art, a device set to a preset time is used to control how long the centrifuge runs at spin speed. By monitoring successive depth measurements (hI, h2, h3 . . . ) during spinning, the PLC is programmed to signal when there is no further reduction in material depth/volume (h) so that deceleration (d) can commence. Again, the preset time values used in the prior art must be set for the "worst case" (high liquid viscosity, low particle size of solids, high solids volume, low temperature, etc.).

It is noted that these "worst case" data values preset for spin control differ substantially from those used in the prior art to control slurry feeding, viz:

| "Worst case" settings for | FEED | END OF SPIN |
|---|---|---|
| Slurry temperature | High | Low |
| Slurry Viscosity | Low | High |
| Solids Content | Low | High |

Values present in the prior art compromise between these conflicting values. The laser measurements/PLC program adjusts feed and the spin time to match the varying requirements of each individual cycle to accommodate changes in the process parameters as they occur.

On the discharge of solids at the end of the cycle, usually by a plough or scraper mechanism, the depth signals, if equal to (M), confirm that discharge is complete and no solids have been retained on the screen. To avoid damage to the screen 7, some scraper mechanisms are set to leave a thin layer of solids (or "heel") on the screen; which reduces the volume of solids discharged and requires partial or complete removal periodically (typically by washing out for reprocessing) as the permeability of the heel reduces and impedes liquid flow. With a heel in the basket, the PLC records the depth—reduced by the radial thickness CD of the heel to (M−j)—at the end of each centrifuge cycle. This corrects the measured volume of solids produced in the next cycle, provides data to process control of the need to reduce the permeability of the heel and of the additional solids to be reprocessed each time the "heel" is removed/reduced.

Industrial high duty centrifuge separating slurries with solids of a narrow particle size range, e.g. sugar crystals, dextrose and fructose, operate as described above to produce high output volumes at high utilisation. Other centrifuges are needed to operate on a variety of slurries of differing solids, wide solid particle size range and various liquid viscosities e.g. pharmaceuticals and fine chemicals. For these centrifuges, when processing low particle sized solids and/or viscous liquids giving low solids permeability, it is beneficial to operate with the basket partly full to avoid the excessively long spin times needed for the high viscosity liquid to flow through a radially wide solids bed. Using a part-filled basket under these conditions may allow a saving in spin time to reduce the overall time of each centrifuge cycle to give a net gain in the overall hourly throughput of the centrifuge.

For these applications, using any system to control basket filling is of limited benefit. Using a prior art system to close the feed valve leaves the remainder of the centrifuge cycle to be controlled by dimensions and times preset to the "worst state" conditions, resulting in under utilisation of the centrifuge. This under utilisation, in which the prior art systems play no part in correcting, is caused by the wide changes occurring in solids permeability and/or liquid viscosity. It is the adjustments made by the laser/PLC system to correct for these changes on a cycle by cycle basis that maintains high centrifuge utilisation for pharmaceuticals, fine chemicals, etc.

Figure 6:
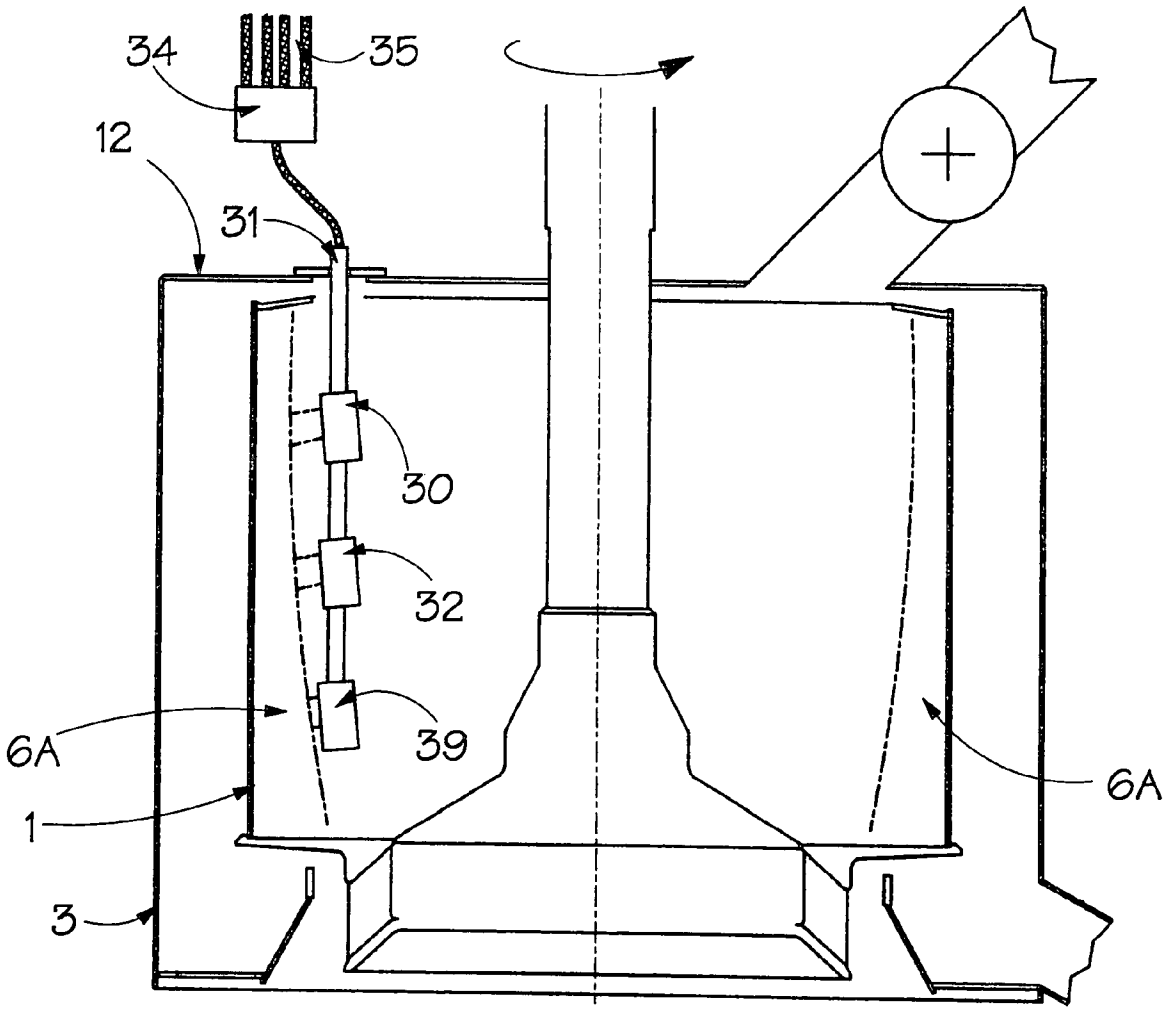
FIGS. 6 and 7 are diagrammatic sectional side elevations of third and fourth embodiments of centrifuges modified in accordance with the present invention.

Some slurries with freely filtering solids, when fed to and accelerated by the centrifuge basket, do not build up to the cylindrical volume 6 but have an inner diameter at the top of the basket more than that at the bottom. The measurement by any means of depth (D) in one position only does not convert accurately to the volume of material in the basket. For such applications two or more laser units are mounted and spaced inside the basket to take a simultaneous series of measurements to cover the material surface. The readings are averaged by the PLC to give a mean value of (D) and thus a true measure of volume. FIG. 6 shows three laser units 30, 36 and 39 mounted to measure a solids load of varying internal diameter.

Figure 7:
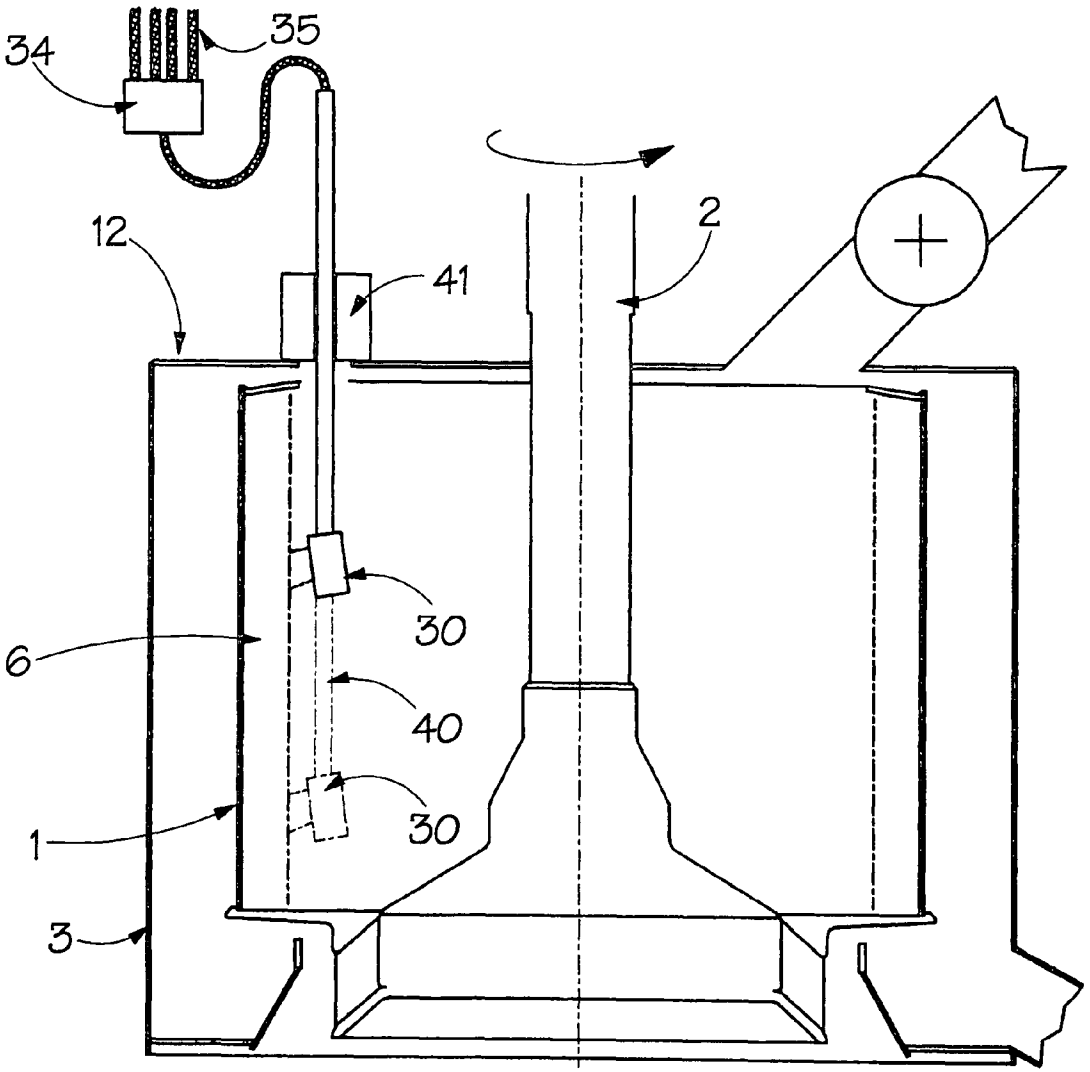

FIG. 7 shows an alternative method of measuring a solids load of varying diameter using a single laser unit mounted on a guide rod 40 arranged to slide in a guide 41 mounted on the casing top 12. The guide rod 40 is set parallel to the shaft 2 to traverse linearly (by a proprietary mechanism—not shown) along a path parallel to shaft 2 and the laser unit 30 mounted thereon measures a series of distances to the inner face of the material in the basket, typically 5 or more readings spaced evenly over the basket surface. The PLC calculates the average value of this series and signals the guide rod 40 to place the laser unit to the position where the individual series measurement equals the average value. The laser unit remains in this position for the remainder of the cycle to deliver measurements to the PLC that convert accurately to material volume. The mean reading is obtained during the feeding of slurry to the basket with the feed rate reduced temporarily during the traversing of the laser unit.

The arrangement shown in FIG. 4 can be adapted in a similar manner to measure a solid's volume of varying thickness by placing the prism 37 and laser unit on a guide rod 40 and guide 41 to traverse and take a series of measurements as described for FIG. 6. The prism reflects the light beam from and to the laser unit and the PLC signals the guide rod to place the prism in the position that equates to the average value of product depths measured during the traverse.

In some situations, it may in practice be appropriate to operate the centrifuges of the present invention at relatively high temperatures, e.g. above 50° C. A problem then arises in that the operation of currently available lasers is unreliable at temperatures above 50° C.

This is overcome by fitting to the centrifuge a cooling device which maintains the laser at a temperature at which it is operationally reliable.

One example of a cooling device which has been found to be useful for this purpose is a so-called vortex cooler that accepts compressed air at room temperature and splits this into output streams, one hot and the other cold. The cold stream is used to cool the laser and the hot stream is discharged to atmosphere.

Figure 8:
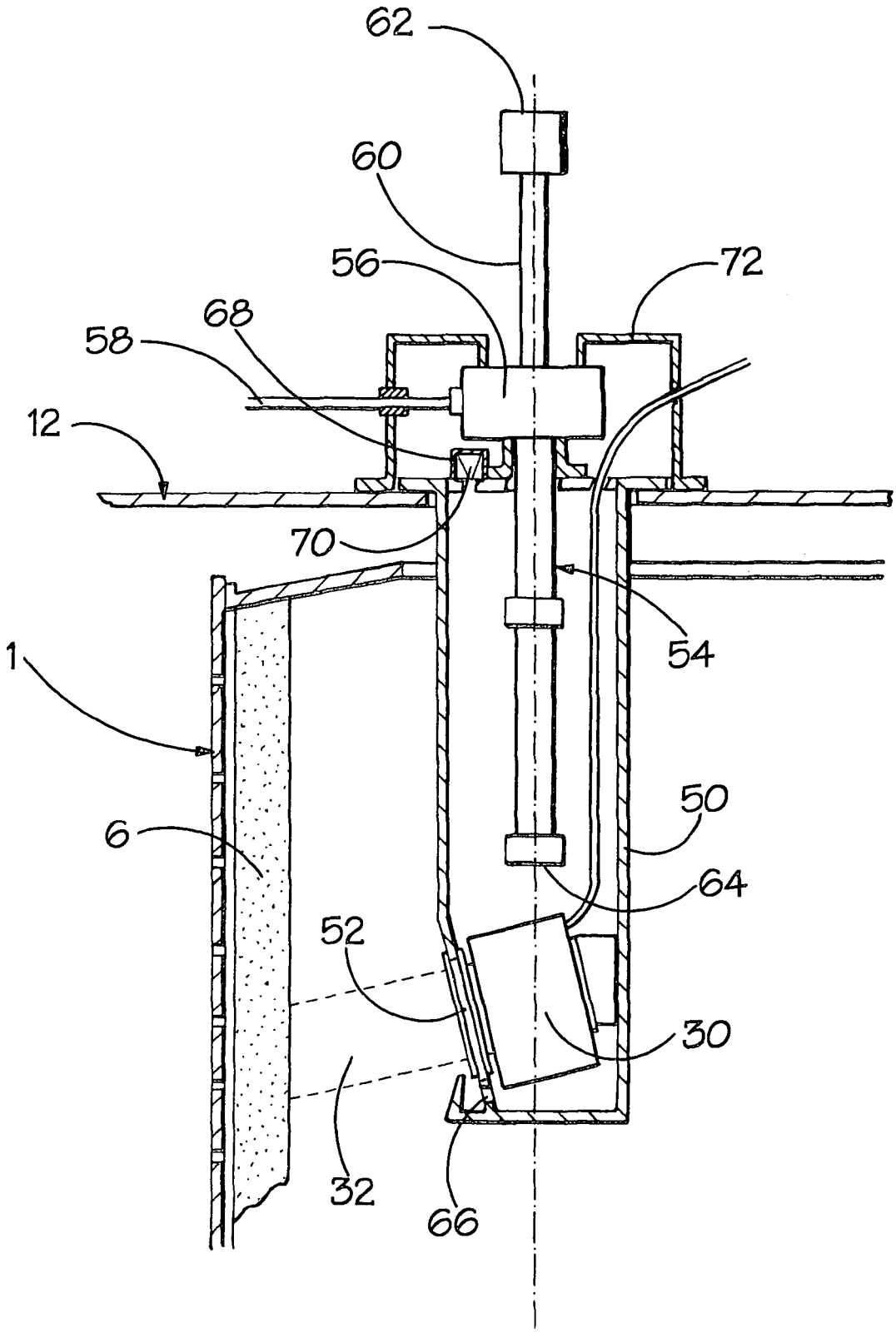
FIG. 8 is a diagrammatic sectional side elevation showing a modification to the embodiment of FIG. 3.

One embodiment of such a cooling device fitted to the centrifuge of FIG. 3 is shown in FIG. 8, which uses the same numbers as in FIG. 3 for equivalent components.

A tube (50) mounted in the casing top (12) contains a window (52) and supports the laser (30) opposite the window (52), allowing the laser light beam (32) to reflect on the surface of the slurry (6) contained in the basket (1).

Mounted partially in the tube (50) is a cooling assembly (54) comprising a chamber (56) supplied with compressed air via a pipe (58), a vortex tube (60), a hot air outlet (62) and a cold air outlet (64) that extends into the tube (50) towards the laser unit (30). When supplied with compressed air through the pipe (58), the chamber (56) and the vortex tube (60) deliver heated air from outlet (62) which exhausts to atmosphere and cooled air from outlet (64) to cool the laser and the interior of the tube (50).

The cooled air exhausts from the tube (50) via an outlet (66) in the tube to pass over the window (52) and remove any solids deposited thereon.

In a preferred arrangement, there is provided a second cooled air outlet (68) to atmosphere containing a throttle valve (70) to adjust the rate of flow of cooled air over the window (52) and allow any surplus cooled air to exhaust to atmosphere via the top cover (72).

Whereas a vortex tube-type cooler of the above described type is currently preferred, any other suitable cooling device for the laser can of course be used as an alternative.

Cooling of the multiplicity of lasers in the FIG. 6 embodiment would be achieved similarly, preferably using a common housing (50).

The invention claimed is:

1. A vertical spindle batch-type centrifuge for processing liquid/solid slurries in discrete batches, comprising:

a stationary casing;

a rotary, perforated, open top basket, suspended within said casing, on whose inner peripheral wall a cylindrical batch of slurry is deposited, in use, as the basket rotates with respect to the casing, so as to retain the solids within the basket and to separate the liquid by filtration via the basket perforations;

a laser arrangement fixed with respect to said casing and positioned to direct one of a continuous stream of pulses and a beam of coherent light energy towards said inner peripheral wall of the basket;

a computing device coupled to said laser arrangement and adapted to calculate continuously over time or at repeated intervals over time a depth and a rate of change of a depth, of the cylindrical batch of slurry contained within the basket, from a series of repeated laser measurements made with said laser arrangement throughout a complete operating cycle of each cylindrical batch of slurry from commencement of slurry feed to discharge of solids; and a feed valve that is opened to deposit the cylindrical batch of slurry in the suspended rotary, perforated, open top basket and that is closed in response to the computing device.

2. A centrifuge according to claim 1, wherein the computing device is arranged to calculate the rate of feed of materials to the basket to enable maximum basket slurry loading.

3. A centrifuge according to claim 1, wherein the computing device is adapted to calculate a volume of material in the basket over the centrifuge cycle, from commencement of slurry feed to discharge of solids.

4. A centrifuge according to claim 1, further comprising a wash pipe for introducing a volume of wash liquid and wherein the results from the series of laser measurements of the material depth in the basket are arranged to be used by the computing device for optimising the volume of wash liquid.

5. A centrifuge according to claim 1, wherein the results from the series of laser measurements of the material depth in the basket are arranged to be used by the computing device for optimising slurry feed and/or basket unloading over each complete operational cycle of the centrifuge.

6. A centrifuge according to claim 1, wherein the computing device provides control signals to a central computer for overall process optimisation.

7. A centrifuge according to claim 1, wherein the computing device is a programmable logic controller (PLC).

8. A centrifuge according to claim 1, wherein the laser arrangement comprises a laser unit disposed at a location within the basket for directing one of a continuous stream of pulses and a continuous beam of coherent light energy towards said inner peripheral wall of the basket.

9. A centrifuge according to claim 1, wherein a distance (M) of the laser arrangement from said inner peripheral wall of the basket is measured with the basket empty and then either continuously or at repeated intervals the distance (m1, m2, m3 . . . ) to the slurry surface is made when a cylindrical batch of slurry is present in the basket, the differences (M−m1, M−m2, M−m3 . . . ) being calculated to establish the prevailing slurry depth.

10. A centrifuge according to claim 9 wherein the computing device is arranged to use the series of measurements to calculate the rate of change of slurry depth and to optimize one or more of the feed, wash and spin components of each operating cycle.

11. A centrifuge according to claim 9 wherein the computing device is arranged to use said difference calculations to establish the rate of change of depth for the purposes of controlling the progress of the operating cycle.

12. A batch-type centrifuge for processing a discrete batch of liquid/solid slurry, the centrifuge having a stationary casing, a basket that rotates on a vertical axis with respect to and within the casing, and a feed valve, the basket having an open top and an inner perforated wall with perforations that retain solids while allowing liquids to pass, the feed valve being opened and closed to deposit a batch of slurry in the basket through its open top, the batch of slurry forming a cylindrical batch of slurry as the slurry enters the basket through the feed valve and the basket spins through a complete operating cycle that includes rotating the basket to feed speed, opening the feed valve to feed slurry to the basket, closing the feed valve, accelerating the basket to spin speed, spinning the basket, and decelerating the basket to discharge the solids, the improvement comprising:

a laser measuring unit fixed with respect to said casing and positioned within the basket and operating to direct one of a continuous stream of pulses and a beam of coherent light energy towards said inner peripheral wall of the basket to measure a distance between the laser measuring unit and a surface of the cylindrical batch of slurry; and a computing device coupled to said laser measuring unit adapted to calculate continuously over time or at repeated intervals over time a depth and a rate of change of a depth, of the cylindrical batch of slurry contained within the basket, from a series of repeated laser measurements made with said laser measuring unit throughout the complete operating cycle, the computing device communicating with the feed valve to open the feed valve and deposit the cylindrical batch of slurry in the basket, calculating the depth and the rate of change of the depth of the cylindrical batch of slurry as the slurry enters the basket through the feed valve, closing the feed valve, and monitoring the depth of the slurry during the spinning of the basket to determine when to decelerate the basket.

* * * * *